US006550169B1

(12) United States Patent
Sena et al.

(10) Patent No.: US 6,550,169 B1
(45) Date of Patent: Apr. 22, 2003

(54) NOVELTY DISPLAY

(76) Inventors: Ronald Sena, 1526 74th St., Brooklyn, NY (US) 11228; Frances Sena, 1526 74th St., Brooklyn, NY (US) 11228

( * ) Notice: Subject to any disclaimer, the term of this patent is extended or adjusted under 35 U.S.C. 154(b) by 0 days.

(21) Appl. No.: 10/074,291

(22) Filed: Feb. 12, 2002

(51) Int. Cl.[7] ..... G09F 19/00
(52) U.S. Cl. ..... 40/410; 40/406
(58) Field of Search ..... 40/406, 409, 410

(56) References Cited

U.S. PATENT DOCUMENTS

| | | | | | |
|---|---|---|---|---|---|
| 2,543,606 | A | * | 2/1951 | Solomon et al. | 40/410 |
| 2,587,620 | A | * | 3/1952 | Hormann | 40/410 |
| 4,028,830 | A | | 6/1977 | Ottinger | |
| 4,190,312 | A | | 2/1980 | Bailey | |
| 4,215,500 | A | | 8/1980 | Sharp | |
| 4,641,445 | A | | 2/1987 | Rossi | |
| 5,200,239 | A | * | 4/1993 | Chen | 40/410 |
| 5,491,916 | A | | 2/1996 | Ingram et al. | |
| 5,502,908 | A | | 4/1996 | Powell et al. | |
| 5,666,750 | A | | 9/1997 | Segan et al. | |
| 5,979,091 | A | * | 11/1999 | TenBrink | 40/410 |
| 6,345,457 | B1 | * | 2/2002 | Bradley | 40/410 |

* cited by examiner

*Primary Examiner*—Gary Hoge
(74) *Attorney, Agent, or Firm*—Collard & Roe, Inc.

(57) ABSTRACT

A novelty display that comprises a housing. Inside the housing is a catch basin. There is also a blower disposed in said housing and coupled to the catch basin. At a top portion of the housing is a tray wherein said tray has a plurality of perforations. There is also a blower tube which is coupled to the blower at one end and the tray at another end. There is also a display disposed in the housing. This display is disposed substantially above the catch basin and substantially below the tray wherein a plurality of particles are fed through the blower in the blower tube and out of the holes in the tray so that the particles fall through the plurality of perforations onto the display and into the catch basin wherein these particles are recycled throughout the display.

5 Claims, 2 Drawing Sheets

NOVELTY DISPLAY

BACKGROUND

The invention relates to a novelty display that displays a novelty scene for users in a window. Essentially this novelty display can be used to display falling snow or scenery so that a store owner can display this scenery.

SUMMARY

A novelty display that comprises a housing. Inside the housing is a catch basin. There is also a blower disposed in said housing and coupled to the catch basin. At a top portion of the housing is a tray wherein said tray has a plurality of perforations. There is also a blower tube which is coupled to the blower at one end and the tray at another end. There is also a display disposed in the housing. This display is disposed substantially above the catch basin and substantially below the tray wherein a plurality of particles are fed through the blower in the blower tube and out of the holes in the tray so that the particles fall through the plurality of perforations onto the display and into the catch basin wherein these particles are recycled throughout the display.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
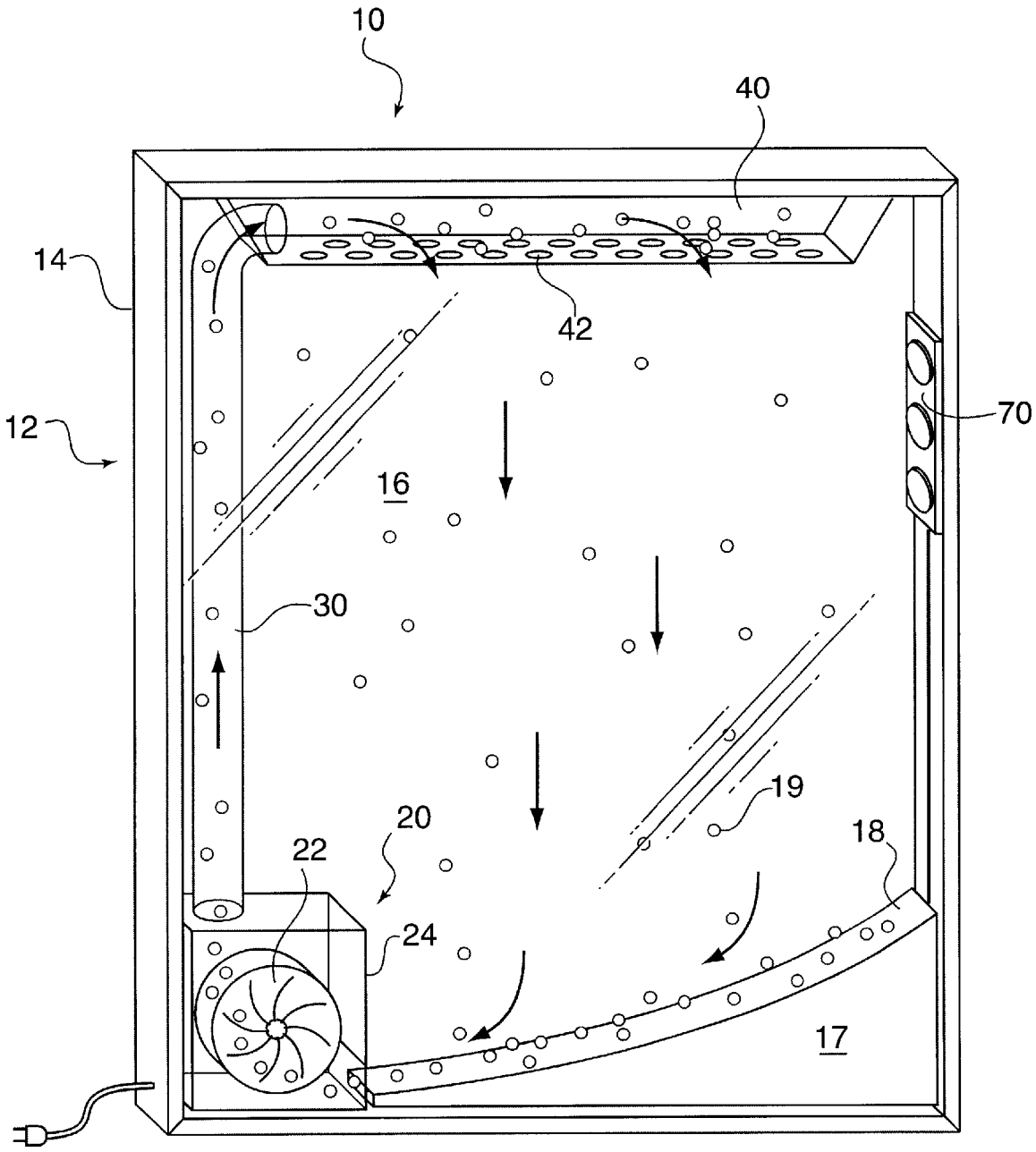
FIG. 1 is a cross sectional view of the display device.

Referring to the drawings, FIG. 1 is a cross sectional view of a display device 10 which includes a housing 12 which has a plurality of side walls 14, a front window 16 (see FIG. 2) and a solid backing or back window (not shown). Disposed inside of housing 12 is a catch basin 17 which is essentially a blocked section containing a plurality of optional perforations 18 for receiving particles 19 falling down within these perforations 18. Catch basin 17 can also have a substantially sheer surface without any perforations wherein this catch basin is angled to receive particles and filter them towards a particular destination.

There is also a blower 20 disposed adjacent to catch basin 17. Blower 20 contains a blower motor 22 and a blower housing 24. Blower housing 24 has an open end adjacent to catch basin 17. Essentially blower motor 22 pulls air and particles either on top of or inside of catch basin 17 and pulls these particles into blower housing 24 and on through blower motor 22.

Blower housing 24 sits in a corner of housing 12. A top section of blower housing 24 contains a hole that allows particles to flow out. Coupled to a top section of blower housing 24 is a blower tube 30. Blower tube 30 essentially allows particles 19 to flow up from blower housing 24 up into a tray 40. Blower motor 22 pumps these particles up through blower tube 30 so that these particles end up floating inside of, and spread throughout tray 40. These particles 19 then fall down through tray 40 out of holes or perforations 42. Particles 19 can then fall on a display shown in FIG. 2 whereby these particles fall back on catch basin 17. These particles can be made out of polystyrene wherein they are colored blue to represent rain, brown to represent leaves, and white to represent snow.

Figure 2:
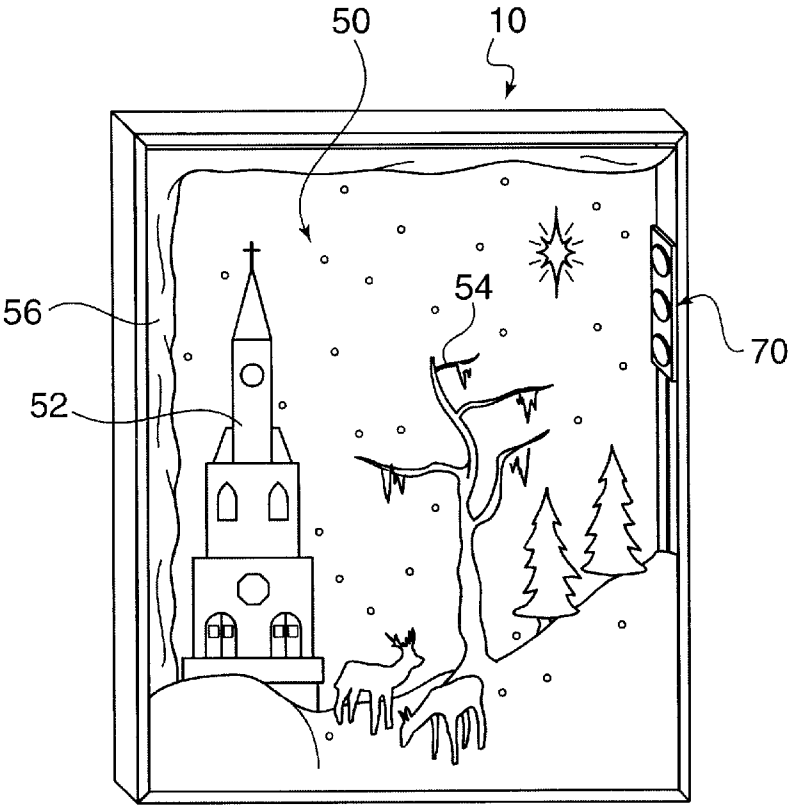
FIG. 2 is a side view of the display device.

FIG. 2 shows a front view of display device 10. Inside of housing 12 is a display 50 showing a winter scene. In display 50 can be a church or other type building 52, a plurality of trees 54 and a landscape formed into blower housing 24 and catch basin 17. There can also be a covering 56 which covers blower tube 30 as blower tube 30 extends up from blower housing 24 into tray 40.

Figure 3:
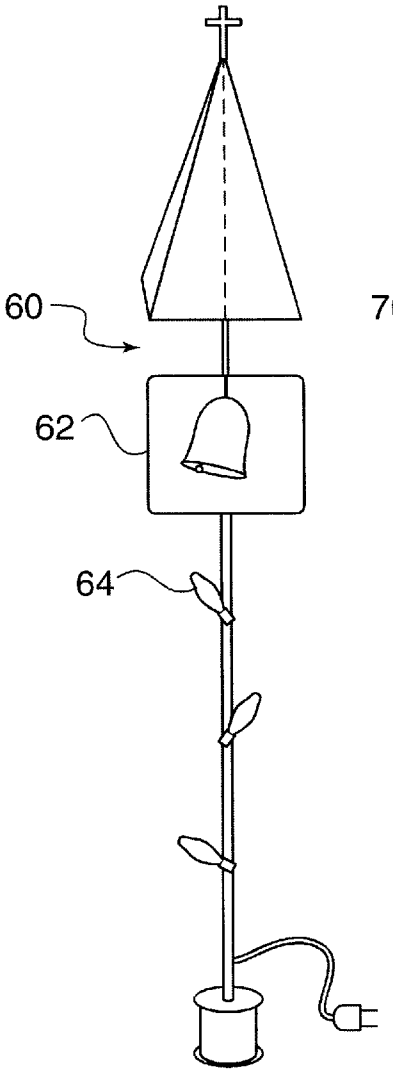
FIG. 3 is a first embodiment of a lamp for the display device.

The display can also include lights. As shown in FIG. 3, a first light device 60 is used to light up building 52. First light device 60 contains the steeple or roof, a bell 62 and a plurality of lights 64 which fit into the different windows in the building.

Figure 4:
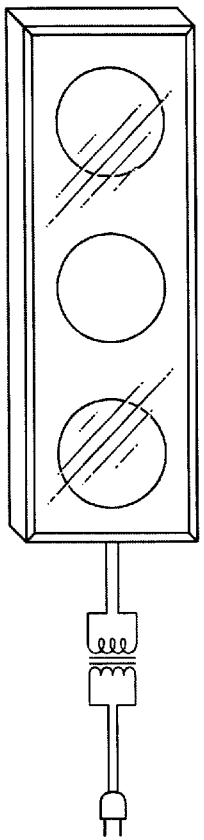
FIG. 4 is a second embodiment of a lamp for a display device.

FIG. 4 shows a plurality of additional lights that are formed as a light frame 70. Light frame 70 provides the overall lighting for the display and can be attached to a side wall of housing 12.

The entire display can be of any size, however, in a preferred embodiment, this display can be used for window shows inside of particular windows such as a storefront window.

In operation, display device 10 can be placed inside of a store window. Next, display device 10 receives a plurality of particles 19 placed on top of catch basin 17 or in blower housing 24. Next, the entire housing is closed and then the blower is turned on. The blower generally runs on electricity provided by an adjacent outlet. Essentially cords from blower 20 and lights 60 and 70 can all be coupled to a surge protected strip disposed inside of the housing (not shown.) This surge protected strip when inserted into a wall outlet provides power to the blower and the lights.

Once blower 20 is turned on blower motor 22 rotates inside of blower housing 24 moving particles through blower housing 24 up through blower tube 30 and into tray 40. Particles float into tray 40 and then fall through holes in tray 40 and down onto catch basin 17. In addition, lights 60 and 70 can be turned on to create a lighted display for a presentation during the evening hours. Lights 60 and 70 can be powered by a transformer coupled to lights 70.

While there is only one display shown, different types of displays can be shown within display housing 12. For example a fall presentation can also be shown wherein instead of having the particles being snowflakes, they can be tiny leaves that are constantly falling to the ground.

Accordingly, while at least one embodiment of the present invention has been shown and described, it is to be understood that many changes and modifications may be made thereunto without departing from the spirit and scope of the invention as defined in the appended claims.

What is claimed is:

1. A novelty display that includes a plurality of particles, the display comprising:

a) a housing;

b) a catch basin disposed in said housing and having a plurality of holes or receiving the plurality of particles;

c) a blower disposed in said housing and coupled to said catch basin;

d) a tray disposed in said housing wherein said tray has a plurality of perforations;

e) a blower tube disposed in said housing wherein said blower tube is coupled to said blower at one end and said tray at another end;

f) a display disposed in said housing, said display being disposed substantially above said catch basin and substantially below said tray wherein the plurality of particles are fed through said blower into said blower tube and out of said perforations in said tray so that said particles fall through said plurality off perforations onto said display and onto said catch basin wherein said particles are recycled throughout the display.

2. The display as in claim 1, further comprising a plurality of lights disposed within said display housing.

3. The display as in claim 1, wherein at least one of said plurality of lights is coupled to a wall on said housing.

4. The display as in claim 1, wherein said blower comprises a blower motor and a blower housing, wherein said blower motor is disposed inside of said blower housing and said blower housing is in communication with said catch basin.

5. A novelty display that includes a plurality of particles, the display comprising:

a) a housing having a removable top, a transparent front and rear pane and a plurality of side walls;

b) a catch basin disposed in said housing and having a plurality of holes for receiving the plurality of particles;

c) a blower disposed in said housing and coupled to said catch basin wherein said blower comprises a blower housing and a blower motor and said blower housing has a hole that is in communication with said catch basin and an additional hole disposed on another side of said blower housing;

d) a tray disposed in said housing wherein said tray has a plurality of perforations;

e) a blower tube disposed in said housing wherein said bower tube is coupled to said additional hole in said blower housing and coupled at an opposite end to said tray;

f) a plurality of lights disposed in said housing; and g) a display disposed in said housing, said display being disposed substantially above said catch basin and substantially below said tray wherein a plurality of particles are fed through said blower into said blower tube and out of said perforation in said tray so that said particles fall through said plurality of perforations onto said display and onto said catch basin wherein said particles are recycled throughout the display.

* * * * *